US006323812B1

(12) United States Patent
Perrotta et al.

(10) Patent No.: US 6,323,812 B1
(45) Date of Patent: Nov. 27, 2001

(54) SECONDARY ANTENNA GROUND ELEMENT

(75) Inventors: Alessandro Perrotta, Ft. Lauderdale, FL (US); Daniel Yeboah, Irving, TX (US); Markus B. Kopp, Deerfield Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/542,819

(22) Filed: Apr. 4, 2000

(51) Int. Cl.[7] ..... H01Q 1/24
(52) U.S. Cl. ..... 343/702; 343/846
(58) Field of Search ..... 343/702, 700 MS, 343/829, 841, 846, 851, 848, 849, 906; H01Q 1/24

(56) References Cited

U.S. PATENT DOCUMENTS 4,755,822 * 7/1988 Chesebro ..... 343/702
4,849,765 * 7/1989 Marko ..... 343/702
4,868,576 9/1989 Johnson, Jr. ..... 343/702
4,876,552 * 10/1989 Zakman ..... 343/702
5,539,417 * 7/1996 Terry et al. ..... 343/702
5,739,791 * 4/1998 Barefield et al. ..... 343/702
6,140,977 * 10/2000 Morales et al. ..... 343/906
6,191,740 * 2/2001 Kates et al. ..... 343/700 MS

* cited by examiner

*Primary Examiner*—Tho Phan
(74) *Attorney, Agent, or Firm*—Scott M. Garrett

(57) ABSTRACT

An antenna feedpoint assembly includes a printed circuit board (400), a signal conductor feed element (2041) mounted on the printed circuit board (400), and a secondary ground element (106) placed parallel to the signal conductor feed element (2041) wherein an electromagnetic coupling is made between the signal conductor feed element (2041) and the secondary ground element (106) for an improved matching of the antenna (100) without an additional matching circuit. The secondary ground element (106) comprises a mounting portion (1061) connected to a ground plane (1002) and a protruded portion (1062) extended from the mounting portion (1061) such that the protruded portion (1062) is elevated from and substantially parallel to the signal conductor feed element (2041) serving as the antenna feedpoint contact.

16 Claims, 7 Drawing Sheets

SECONDARY ANTENNA GROUND ELEMENT

TECHNICAL FIELD

This invention is generally related to antennas and more particularly to antennas for portable communication devices.

BACKGROUND

As improved integrated circuit technology allows portable communication devices, such as transceivers and radiophones, or their combination, to be reduced in size, it is also desirable to reduce the overall length of the antenna structure used with such devices. One style of antennas is the half wave dipole antenna which requires no extensive ground plane to operate. Half wave dipole antennas produce highly desirable and predictable electrical performance. However, these antennas are large and therefore are undesirable for portable applications.

One of the smallest antenna structures frequently used with portable transceivers is a quarter wave length whip antenna which requires an extensive ground plane to operate effectively. A quarter wave whip antenna radiates at acceptable levels below the standards of the halfwave dipole, however with the benefit of reduced length. The much reduced size of portable communication devices has also reduced the size of the available ground plane. Consequently, the ground interacts with a high level of sensitivity to its surrounding environment. The smaller the antenna and ground become, the more the Q of the system increases, making the antenna and frequency bandwidth of operation smaller.

An antenna grounding improvement is therefore desired that can be used with small portable communication products.

BRIEF DESCRIPTION OF THE DRAWINGS

The features of the present invention, which are believed to be novel, are set forth with particularly in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
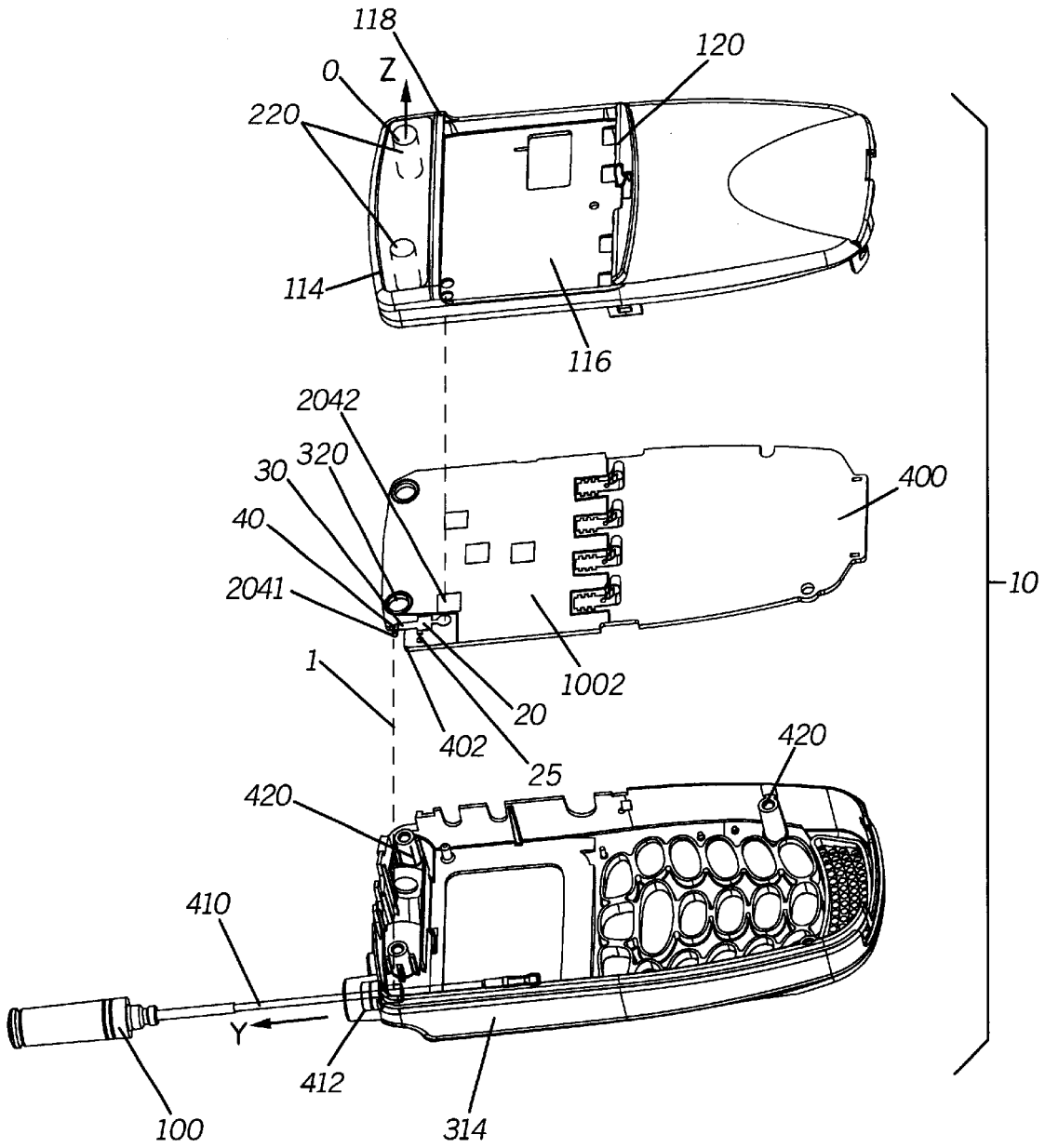
FIG. 1 shows an antenna structure in a communication device, with a secondary ground element 106 hidden underneath the top-side of a back housing 114, in accordance with the present invention.
Figure 2:
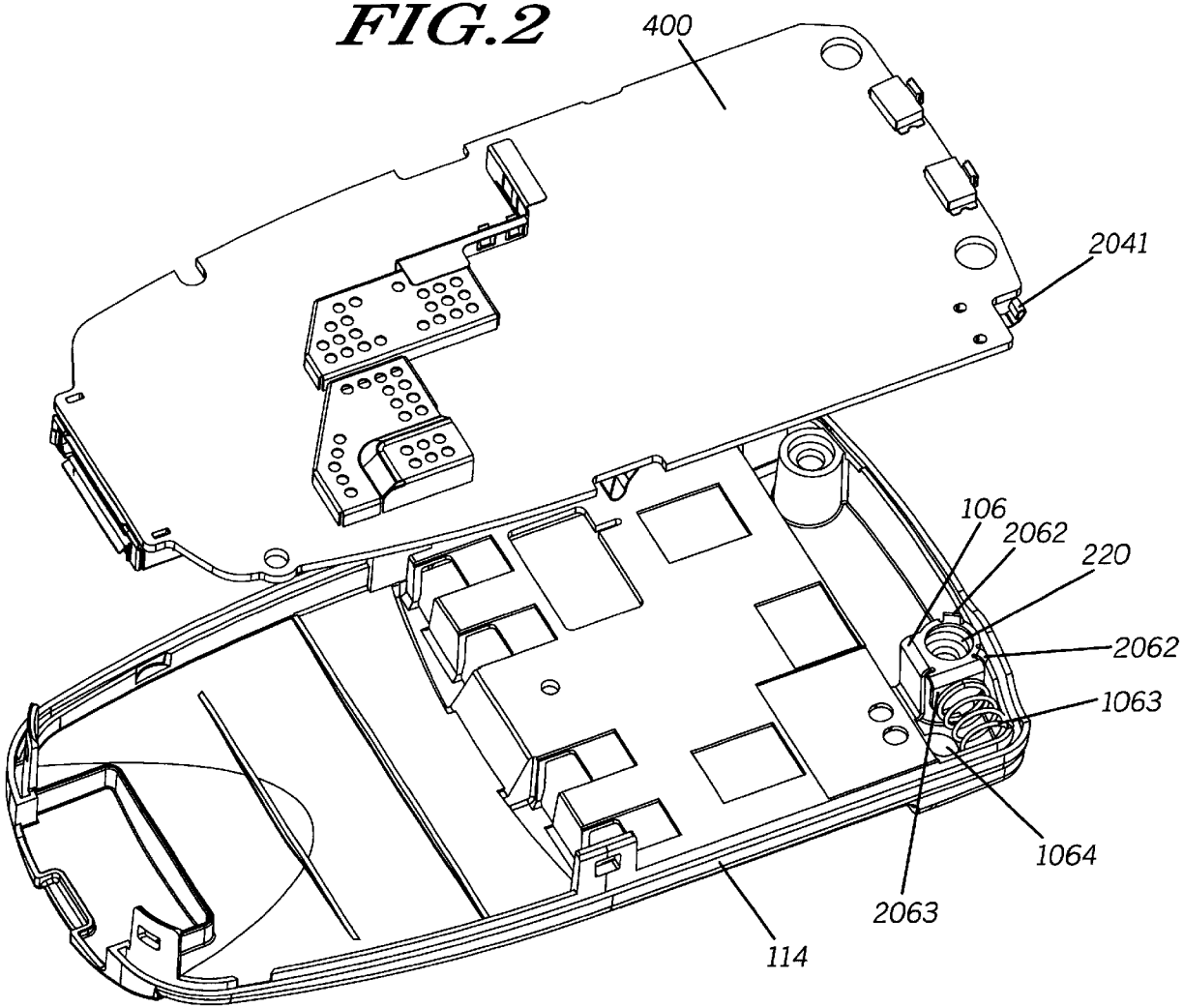
FIG. 2 shows the underside of the back housing 114 of the communication device of FIG. 1, with the secondary ground element 106 mounted, in accordance with the present invention.

The principles of the present invention will be better understood by referring to a series of drawings where like numerals are carried forward but dimensions are not to scale or in their actual proportions. Referring to FIGS. 1 and 2, a quarter wave antenna 100 is shown. Basically, in accordance with the teachings of the present invention, an antenna feedpoint assembly includes a printed circuit board 400, a signal conductor feed element 2041 mounted on the printed circuit board 400, an antenna bushing 412, and a secondary ground element 106, hidden underneath a back housing 114 but which can better be seen in the back housing's underside of FIG. 2.

Figure 7:
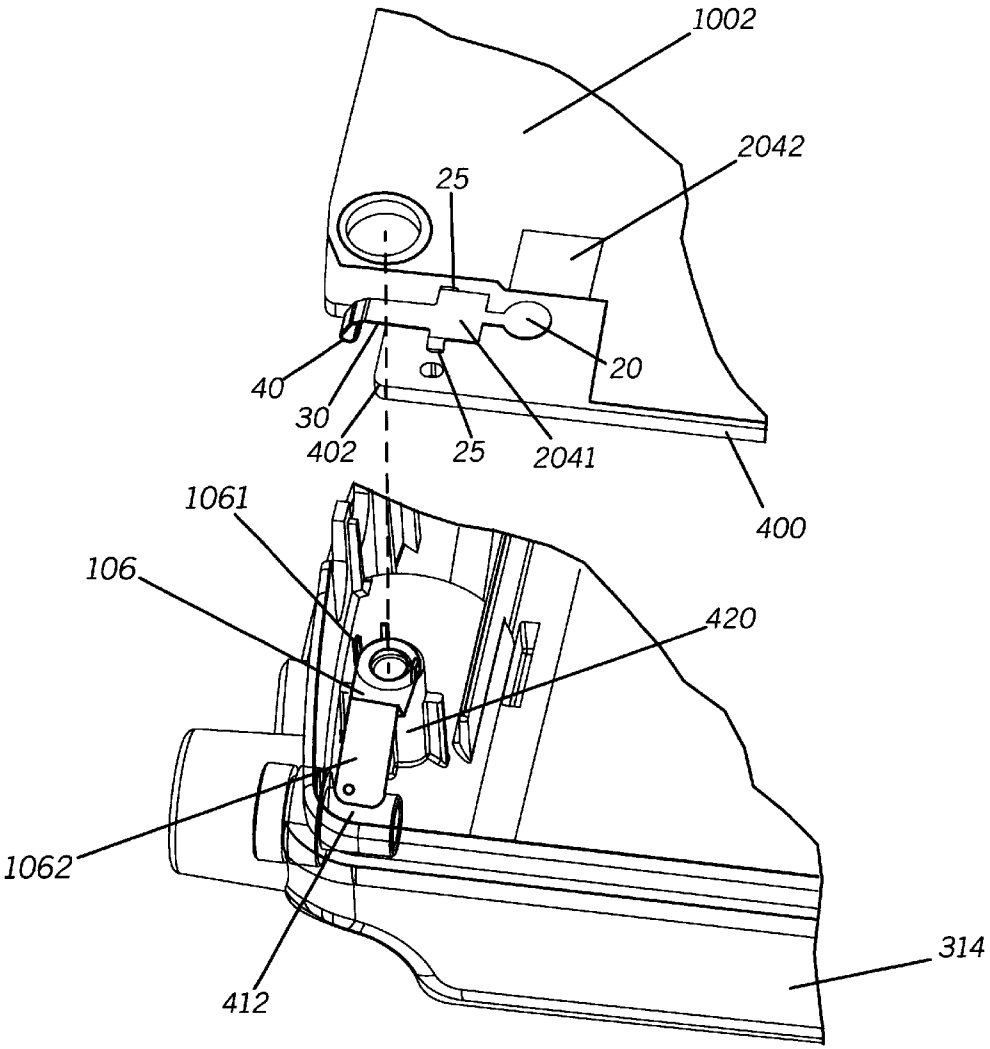
FIG. 7 represents a perspective side view of the secondary ground element 106 of FIG. 6 in relationship with the antenna feedpoint structure, in accordance with the present invention, but with the substrate 400 removed to show the antenna bushing 412 underneath.
Figure 8:
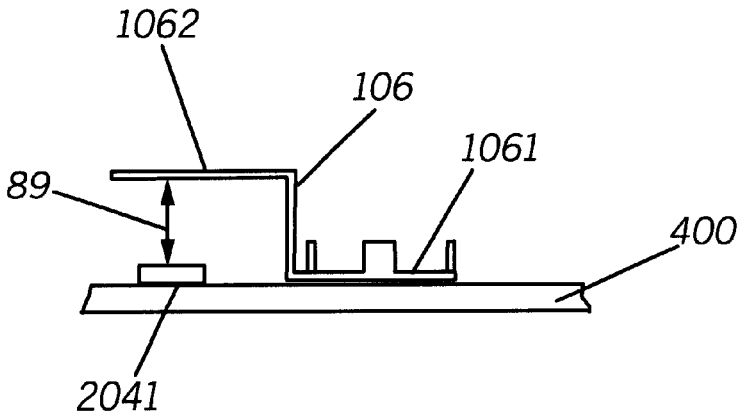
FIG. 8 shows a simplified front cross-sectional view of the secondary ground element 106 of FIG. 7 with the antenna contact 2041 in a simulated transmission line, in accordance with the present invention.
Figure 9:
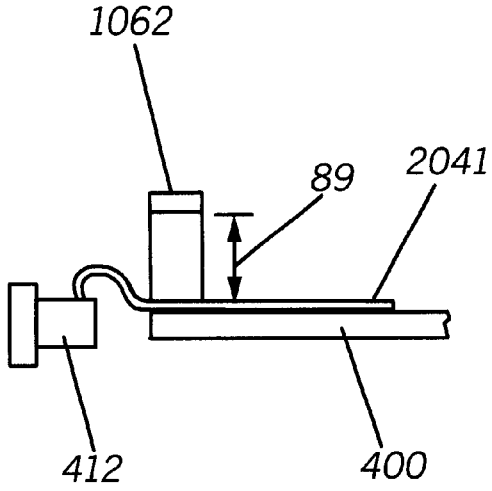
FIG. 9 shows a simplified side cross-sectional view of the secondary ground element 106 of FIG. 7 with the antenna contact 2041 in a simulated transmission line, in accordance with the present invention.

Referring now to the simplified drawings of FIGS. 8–9, the secondary ground element 106 is placed parallel to the signal conductor feed element 2041, and antenna bushing 412. With this arrangement, an electromagnetic coupling is made between the signal conductor feed element 2041, antenna bushing 412, and the secondary ground element 106 for an improved matching of the antenna 100 without an additional matching circuit. Better seen in FIG. 7, the secondary ground element 106 comprises a mounting portion 1061 connected to a ground plane 1002 and a protruded portion 1062 extended from the mounting portion 1061 such that the protruded portion 1062 is elevated from and substantially parallel to the signal conductor feed element 2041 serving as the antenna feedpoint contact.

Referring back to FIGS. 1, 8, and 9, the signal conductor feed element 2041 and antenna bushing 412 are used to couple the antenna 100 to a communication device, such as a radio, a phone, a pager, or their combination. The antenna 100 includes a center conductor 410 connected to another optional connector (not shown) which provides internal screwable contact to the antenna bushing 412. In the preferred embodiment, the center conductor has a range of operating frequencies between 800 MHz and 1.8/1.9 GHz. The close proximity of the center conductor 410, the antenna bushing 412, and the center conductor feed element 2041, to the ground 1002, extended by the secondary ground element 106, at the feedpoint end of the antenna 100 shown by the distance 89, increases bandwidth and radiation efficiency without the additional components or the complexity of matching circuits. In this preferred embodiment, the distance 89 is approximately 0.7 mm. However, in general, a distance between 0.5 mm and 2.0 mm is envisioned by the teachings of the present invention.

Figure 3:
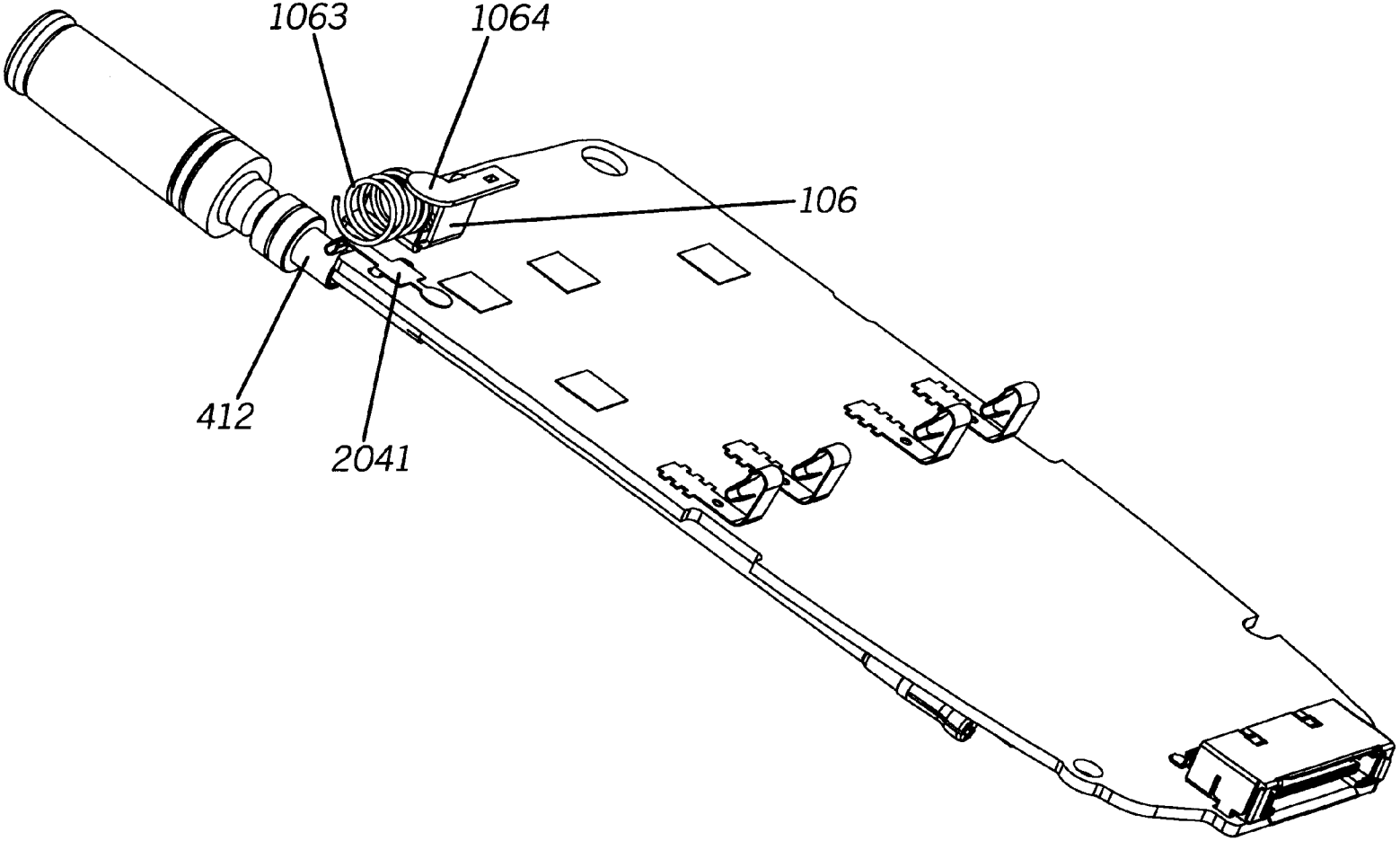
FIG. 3 shows a perspective side view of the secondary ground element 106 of FIG. 2 in relationship with the antenna feedpoint structure, in accordance with the present invention.
Figure 4:
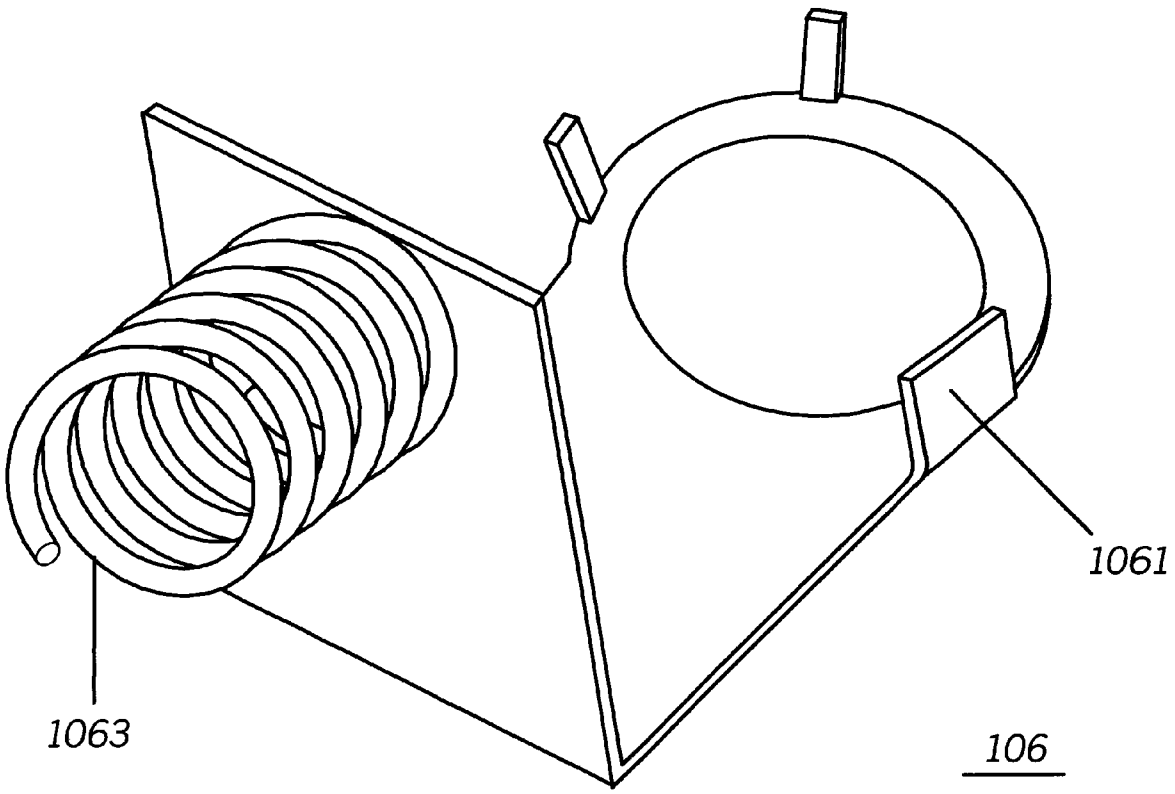
FIG. 4 shows a simplified representation of an alternative form of the secondary element 106, in accordance with the present invention.

The feedpoint structure of the antenna 100 solves the problems of the prior art by almost confining the fields generated through the conductor feed element 2041 to ground and providing a better feedpoint. The almost shorted transmission line that is thus produced acts as a low Q matching element and feeds the transmitted power to the antenna. If the secondary ground element 106 is implemented with a coil extension 1063, as in FIGS. 3 and 4, the element 106 behaves as an additional high Q inductance. Alternatively, the protruded portion 1062 serves as extra capacitance, as provided by an optional plate, as the protruded portion 1062 in FIGS. 6–9 or an additional planar extension 1064 to the coil 1063 of the embodiment in FIGS. 2 and 3. Thus, the input impedance of the quarterwave monopole can be matched to 50 ohms without any discrete matching components and with minimum losses.

Referring back to FIG. 1, the length of the center conductor 410 is substantially a quarter wave length at the operating frequency of the transmit signal. The quasi transmission line feed includes the antenna contact 2041 connected to bushing 412 and the ground plane 1002 extended by the secondary ground element 106 of FIG. 2 and a dielectric within the distance 89 in FIGS. 8–9 of air between the antenna contact or feed element 2041 and the secondary ground element 106. The dielectric between the ground plane 1002 and the antenna contact 2041 on one side and their through holes on the opposed side may be any well known dielectric used in transmission line applications such as TEFLON® or any suitable printed circuit board material. The center conductor 410 is connected to the radio communication device via the antenna bushing 412 of the feedpoint end 2041 of the antenna. This antenna feedpoint structure provides for the efficient radiation of the transmit radio frequency signal without the historical potentially lossy discrete matching components required to improve and enlarge the bandwidth of the quarter wave antenna.

Highlighted parts of a communication device 10 will be described in more detail to show the relationship between the antenna feedpoint assembly and the rest of the communication device 10, in accordance with the teachings of the present invention. The communication device 10 includes the front housing 314 on which the antenna bushing 412 is located. The center conductor 410 of the antenna is preferably attached to the radio communication device 10 via the bushing. By connecting the center conductor 410 to the antenna bushing 412 and subsequently to the antenna contact, a quarter wave resonant antenna operates much more efficiently, without the need for additional matching elements. If the protruded portion 1062 of the secondary ground element 106 in FIG. 8 takes on the form of a coil 1063, the secondary ground element 106 acts like a large inductance at the frequency of operation. This action moves the non-ideal quarterwave antenna closer to the center of the well known impedance matching Smith chart (50 ohm point). The key is the almost shorting of the center conductor 412 to the ground plane 1002, via the parallel and close transmission line or other type of electromagnetic coupling between the secondary ground element 106 and the combination antenna bushing 412/feed element 2041. With such a scheme, quarter wave antenna operates more efficiently without additional matching circuits. In fact, the matching is automatically provided by almost shorting the combination antenna bushing 412/antenna contact 2041 to the secondary ground element 106 to simulate a transmission line.

The antenna feedpoint assembly is both constrained and supported by the housing of the communication device 10. The antenna contact 2041 and the secondary ground element 106, in sheet metal and single wire forms, are ideal for applications having tight space and high deflection requirements. For example, a phone using the teachings of the present invention could measure just 4.5×2.2×1.2 inches (115×56×30 mm) and weighs as little as five ounces (142 grams) with a Lithium Ion battery (not shown). The battery is piggy-backed or mounted to a back cover 114 which is mated to the front housing or cover 314 of the radio or communication device. The back housing or cover has a raised back housing portion to recess a battery compartment cavity 116 formed therein between first 118 and second 120 side wall s for receiving the battery. This raised back housing portion is bored through to form at least one internal boss 220 more clearly seen in FIG. 2.

The substrate, preferably in the form of a printed circuit board (PCB) 400, has a notch 402 cut-away, in the corner nearest the first sidewall 118, closest to the radio antenna 410. The PCB substrate 400 contains radio frequency (RF) circuitry and other circuitry including the ground plane 1002 and other ground accessible points such as 2042. Near the top edge of the substrate, at least one aperture 320 has a solder pad formed around its periphery. This substrate 400 seen in FIG. 2 is inserted underneath the secondary ground element 106 for resting within the top of the screw support 420 of FIG. 1.

To show further detail, the radio front cover 314 has the antenna bushing 412, preferably ultrasonically inserted at the top of the front cover 314, for receiving the radio antenna 410. The front cover 314 mates with the back cover 114, containing the battery compartment 116, for encapsulating the substrate board 400 in- in-between. Optionally, the front cover 314 has support members or screw support 420 with a wider base for elevating the substrate 400 to the height needed for forming the back support for and resting the back cover 114. The top of the screw support 420 protrudes through the solder surrounded aperture 320 of the substrate 400 for allowing a screw (not shown) to be inserted and tighten through the boss 220 of the back housing 114 of FIG. 2 when the boss 220 mates with the screw support 420 over the substrate's aperture 320.

Referring to FIG. 2, the secondary ground element is designed to fit around the boss 220 and underneath the raised back housing portion between the two different levels of the substrate 400 and the underside of the raised portion. To optimize this fit, the secondary ground element 106 is preferably S-shaped (better seen in FIG. 8) to form a metal retainer boss covering. The mounting portion of the boss covering is provided by a grommet-shaped ring retainer having an eyelet 2061 surrounded by at least one retaining leg 2062 and a sidewall 2063. The protruded portion, at the top of the "S" comprises a planar 1062 (in FIG. 7) or an optional coil 1063 extension to the sidewall (body or vertical member of the "S") 2063 such that the planar extension/coil 1062, the sidewall 2063, and the eyelet (bottom of the "S" for mating with the substrate 400 below) 2061 together provide an S-shaped retainer. Hence, the mounting portion formed by the sidewall 2063 and the eyelet 2061 provides a sheet metal portion having sufficient retaining elements to be captured between the underside of the internal boss 220 and the printed circuit board 400. The protruded portion 1063 then extends from the sheet metal mounting portion 2063 and resides underneath the raised back housing portion such that the protruded portion is elevated from and substantially parallel to a cantilevered hook or beam portion 30 (seen in FIG. 1) of the signal conductor feed element 2041 and the antenna bushing 412.

Electrically, the ground element 106 thus acts as a ground plane which retains the electromagnetic energy between it, the feed element 2041, and the antenna bushing 412, to mimic a transmission line as simplified in FIGS. 8–9. This transmission line configuration limits the radiation energy that would normally escape from this feedpoint area and allows the antenna to radiate more efficiently.

Referring back to FIG. 1, the feed element or RF circuitry contact 2041 includes a resilient metal form or tab for making a connection inside 1 the radio. Preferably, the resilient metal is in the form of a "J"-shaped sheet metal hook 2041 having a base portion 20, a "J"-shaped tip portion 40, and the cantilever beam portion 30 integrally connecting the tip 40 to the base 20 (details in FIG. 7). The base portion 20 is surface mounted on top of the substrate 400. The cantilever beam portion 30 extends from the base portion 20, over the notch 402, such that the "J"-shaped tip portion 40, terminating the cantilever beam portion 30, can protrude through the notch 402 for resiliently biasing the antenna bushing 412 underneath. At the same time, this RF or positive terminal antenna contact 2041, serves as the hot contact, or RF connection for the antenna 410, via the antenna bushing 412, to connect the antenna 410 to the radio frequency circuitry of the rest of the radio through the electrical conductive path of the substrate 400. Optionally, the base 20 of the "hot" RF contact 2041 has a pair of legs 25 that are inserted and soldered through a pair of through holes to provide better support.

This cantilever design allows an easier blind assembly of the substrate 400 to the antenna 410, in a small package, without the risk of damaging the hot contact. Adjacent to the hot contact 2041 on the substrate 400, a ground contact 2042 is also surface mounted on top of the substrate 400 to provide a ground terminal for the radio frequency circuitry.

Figure 5:
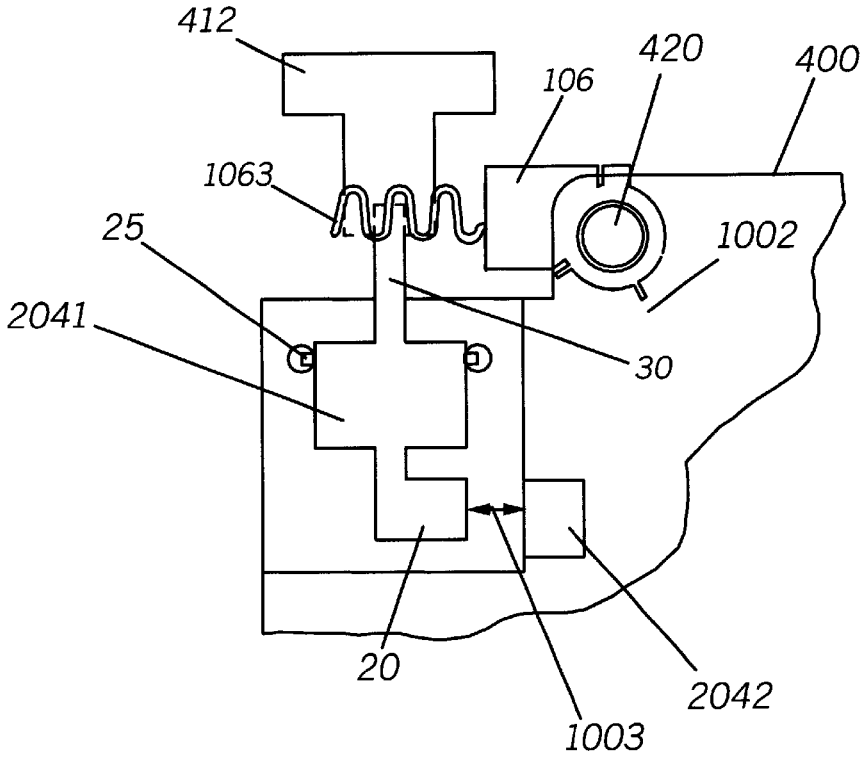
FIG. 5 shows a simplified top view of the antenna feedpoint structure related to the simplified secondary element 106 of FIG. 4, in accordance with the present invention.
Figure 6:
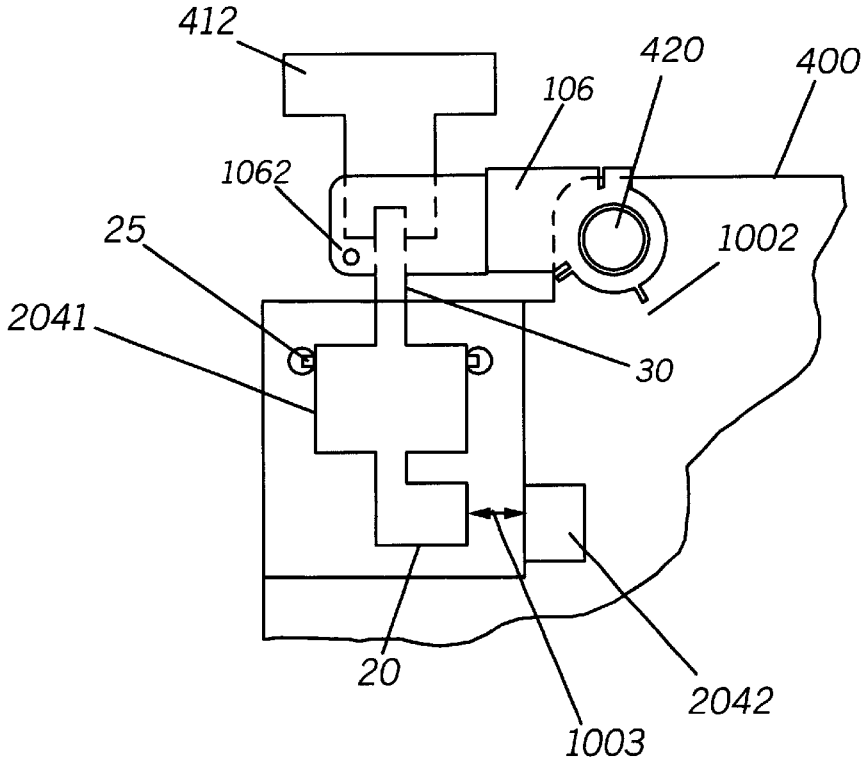
FIG. 6 shows a simplified top view of the antenna feedpoint structure related to another simplified secondary element 106 having a plane extension 1062 instead of a coil extension 1063, in accordance with the present invention.

In FIGS. 5–6, certain like numbers and items of FIG. 1 are carried forward to show the RF contacts in more detail and in context with other components but without further reference to them. In this top view of the hot RF contact 2041, the secondary ground element 106 is shown overlaid on top in a very simplified representation. The shapes of the "hot" or positive RF contact 2041 and the secondary ground element 106 are shown different than in FIG. 1 to show the allowable geometrical variations in the contact and element configurations. Optimizing the antenna feedpoint structure is quite a difficult task, as many physical laws need to be followed. For example, the circular or squarish end of the base 20 of the hot point contact and the ground point or negative contact 2042 can not be located too far apart in order to avoid ground loop currents. It is recommended with this invention that a distance 1003, no greater than 4 mm, be used between the termination points of these two adjacent contacts 2041 and 2042. Preferably, the area around the "hot" RF contact 2041 is not covered with the resist layer covering the ground plane 1002 in order to provide the desired ground relief for the "hot" contact 2041. The resist is a light thin film deposited on the ground 1002 of the PC board 400 and functioning to isolate the circuit from any potential shorts. In the actual radio example, the "hot" contact base termination comes within 0.03 inches or 0.75 mm of the ground resist area to prevent the ground from becoming an antenna.

In addition, the diameter of the circular or sides of the squarish base termination 20 of the hot test point 2041, serving as the antenna launch feed, must not be larger than 0.020 inches or 0.4 mm in order to avoid the larger base rectangular or squarish area of the hot contact above the termination, providing the launch or actual feedpoint to the RF circuitry below the PC board 400, to be too large and radiate inside the radio. To provide strength to the soldered joints formed by the legs 25, this feedpoint area needs to be as large as possible without being too large to interfere with RF propagation. The hot contact basically can be of any shape but it can not exceed 0.09 inches or 2.25 mm in its largest dimension. In other words, the overall length of the antenna launch area, including the antenna bushing 412, the cantilevered contact portion 30, the base contact portion 20 (containing the circle and the square or two squares connected by a rectangular path) should be kept below 15 mm.

While the different preferred embodiments of the invention have been illustrated and described, it will be clear that the invention is not so limited. Numerous modifications, changes, variations, substitutions and equivalents in the shape of the secondary ground element will occur to those skilled in the art without departing from the spirit and scope of the present invention as defined by the appended claims

What is claimed is:

1. A communication device, comprising:

a transmitter for producing a transmit signal having an operating frequency, the transmitter having a feedpoint and a ground;

a center conductor for radiating the transmit signal;

a housing;

a connector for connecting the center conductor to the top of the housing;

a printed circuit board having a notch and located within the housing;

a signal conductor feed element having a cantilevered hook mounted on the printed circuit board and the cantilevered hook resiliently engaging the connector over the notch for connecting the center conductor to feedpoint of the transmitter; and a secondary ground element connected to the ground of the transmitter, mounted within the housing and placed parallel to the signal conductor feed element wherein an electromagnetic coupling is made between the signal conductor feed element and the secondary ground element for an improved matching of the antenna without a matching circuit.

2. The communication device of claim 1, wherein the center conductor has a length close to a quarter wavelength at the operating frequency.

3. The communication device of claim 1, wherein the center conductor has a range of operating frequencies between 800 MHz and 1.8/1.9 GHz.

4. The communication device of claim 1, wherein the connector comprises an antenna bushing.

5. The communication device of claim 1, wherein the housing includes an internal boss bored from a raised back housing portion.

6. The communication device of claim 5, wherein the secondary ground element comprises:

a sheet metal portion having retaining elements to be captured between the underside of the internal boss and the printed circuit board; and a protruded portion extended from the sheet metal portion and residing underneath the raised back housing portion such that the protruded portion is elevated from and substantially parallel to the cantilevered hook of the signal conductor feed element.

7. The communication device of claim 6, wherein the protruded portion comprises a coil.

8. The communication device of claim 6, wherein the protruded portion comprises a coil to provide inductance to the feedpoint.

9. The communication device of claim 6, wherein the protruded portion comprises a shield to simulate a transmission line with the cantilevered hook of the signal conductor feed element.

10. The communication device of claim 6, wherein the protruded portion comprises a shield to provide capacitance to the feedpoint.

11. An antenna assembly, comprising:

a quarter wavelength center conductor;

a housing;

a connector for connecting the quarter wavelength center conductor to the top of the housing;

a printed circuit board having a notch;

a signal conductor feed element having a hook mounted on the printed circuit board and the hook resiliently engaging the connector over the notch; and a secondary ground element mounted within the housing and placed parallel to the signal conductor feed element wherein an electromagnetic coupling is made between the signal conductor feed element and the secondary ground element for an improved matching of the antenna without a separate matching circuit;

wherein the secondary ground element comprises an S-shaped metal retainer.

12. A secondary ground element comprises:

a mounting portion connected to a ground plane; and a protruded portion extended from the mounting portion such that the protruded portion is elevated from and substantially parallel to an antenna feedpoint contact;

wherein the mounting portion comprises a housing boss covering comprising a grommet-shaped ring retainer having an eyelet surrounded by at least one retaining leg and a sidewall.

13. The secondary ground element of claim 12, wherein the protruded portion comprises a coil.

14. The secondary ground element of claim 12, wherein the protruded portion comprises a shield.

15. The secondary ground element of claim 12, wherein the protruded portion comprises a planar extension to the sidewall such that the outline of the planar extension, the sidewall, and the eyelet in combination provides an S-shaped retainer.

16. The secondary ground element of claim 12, wherein the protruded portion comprises a coil attached to the sidewall at a level different than the level of the eyelet.

* * * * *